US006889581B2

(12) United States Patent
Chen

(10) Patent No.: US 6,889,581 B2
(45) Date of Patent: May 10, 2005

(54) WRENCH CAPABLE OF CLAMPING A SCREWED MEMBER AND PREVENTING THE SCREWED MEMBER FROM SLIPPING OUT OF A SOCKET OF THE WRENCH AND PERMITTING THE SCREWED MEMBER TO PASS THROUGH THE SOCKET

(75) Inventor: Hui Ling Chen, Taichung Hsien (TW)

(73) Assignee: Ohi-Ching Hsieh, (TW)

( * ) Notice: Subject to any disclaimer, the term of this patent is extended or adjusted under 35 U.S.C. 154(b) by 0 days.

(21) Appl. No.: 10/673,274

(22) Filed: Sep. 30, 2003

(65) Prior Publication Data

US 2005/0066778 A1 Mar. 31, 2005

(51) Int. Cl.[7] ..... B25B 13/04
(52) U.S. Cl. ..... 81/125; 81/13
(58) Field of Search ..... 81/125, 13, 177.85, 81/58–58.5, 60–63.2

(56) References Cited

U.S. PATENT DOCUMENTS 145,399 A * 12/1873 Colbert ..... 81/58.3
2,271,887 A * 2/1942 Kalbeck ..... 192/43.2
2,805,594 A * 9/1957 Fogel ..... 81/125
3,485,118 A * 12/1969 Maughan, Jr. ..... 81/125
4,570,513 A * 2/1986 Thompson ..... 81/125
4,663,998 A * 5/1987 Parsons et al. ..... 81/125
5,626,062 A * 5/1997 Colvin ..... 81/63.2
6,516,689 B1 * 2/2003 Bates ..... 81/60
6,718,849 B2 * 4/2004 Haas ..... 81/55
2003/0150301 A1 8/2003 Chih-Ching ..... 81/124.3

* cited by examiner

*Primary Examiner*—Joseph J. Hall, III
*Assistant Examiner*—David B. Thomas
(74) *Attorney, Agent, or Firm*—Dennison, Schultz, Dougherty & MacDonald

(57) ABSTRACT

A wrench including a stem having a head section at one end of the stem and a polygonal socket formed in the head section for fitting onto a screwed member. A resilient ring is disposed at the head section and pivotally connected with a controlling switch pivotally disposed at the head section. By means of operating the controlling switch, the resilient ring is driven to expand or close. In the closed position, the resilient ring obstructs at least one inner angle of the socket to prevent the screwed member from detaching out of the socket and clamp the screwed member in the socket. In the expanded position, the resilient ring frees the inner angle, permitting the screwed member to freely pass through the socket.

12 Claims, 8 Drawing Sheets

WRENCH CAPABLE OF CLAMPING A SCREWED MEMBER AND PREVENTING THE SCREWED MEMBER FROM SLIPPING OUT OF A SOCKET OF THE WRENCH AND PERMITTING THE SCREWED MEMBER TO PASS THROUGH THE SOCKET

BACKGROUND OF THE INVENTION

The present invention is related to a hand tool, and more particularly to a box-end wrench. A resilient ring is disposed in the box end. The diameter of the resilient ring is changeable, whereby the wrench is capable of clamping a screwed member and preventing the screwed member from slipping out of a socket of the wrench. Also, the wrench permits the screwed member to freely pass through the socket.

A conventional box-end wrench has a polygonal socket for fitting onto a screwed member such as a nut or a bolt and wrenching the same. The polygonal socket passes through the box end of the wrench so that the screwed member is easy to slip out of the socket. Accordingly, the box end of the wrench is generally formed with a stop structure for preventing the screwed member from slipping out of the socket. However, when fitting the wrench onto the screwed member, the stop structure disables the screwed member from freely passing through the socket.

SUMMARY OF THE INVENTION

It is therefore a primary object of the present invention to provide a wrench is able to prevent a screwed member from slipping out of the socket of the wrench. As necessary, the wrench can clamp and hold the screwed member in the socket or permit the screwed member to freely pass through the socket.

The present invention can be best understood through the following description and accompanying drawings wherein:

DETAILED DESCRIPTION OF THE PREFERRED EMBODIMENTS

Figure 1:
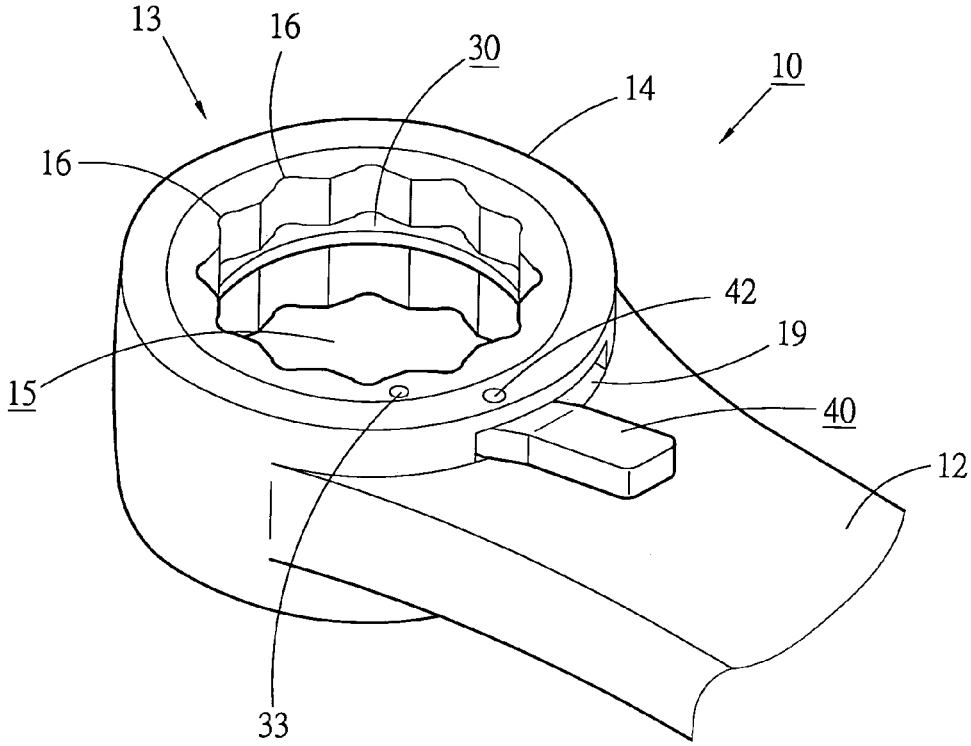
FIG. 1 is a perspective assembled view of a preferred embodiment of the present invention.
Figure 2:
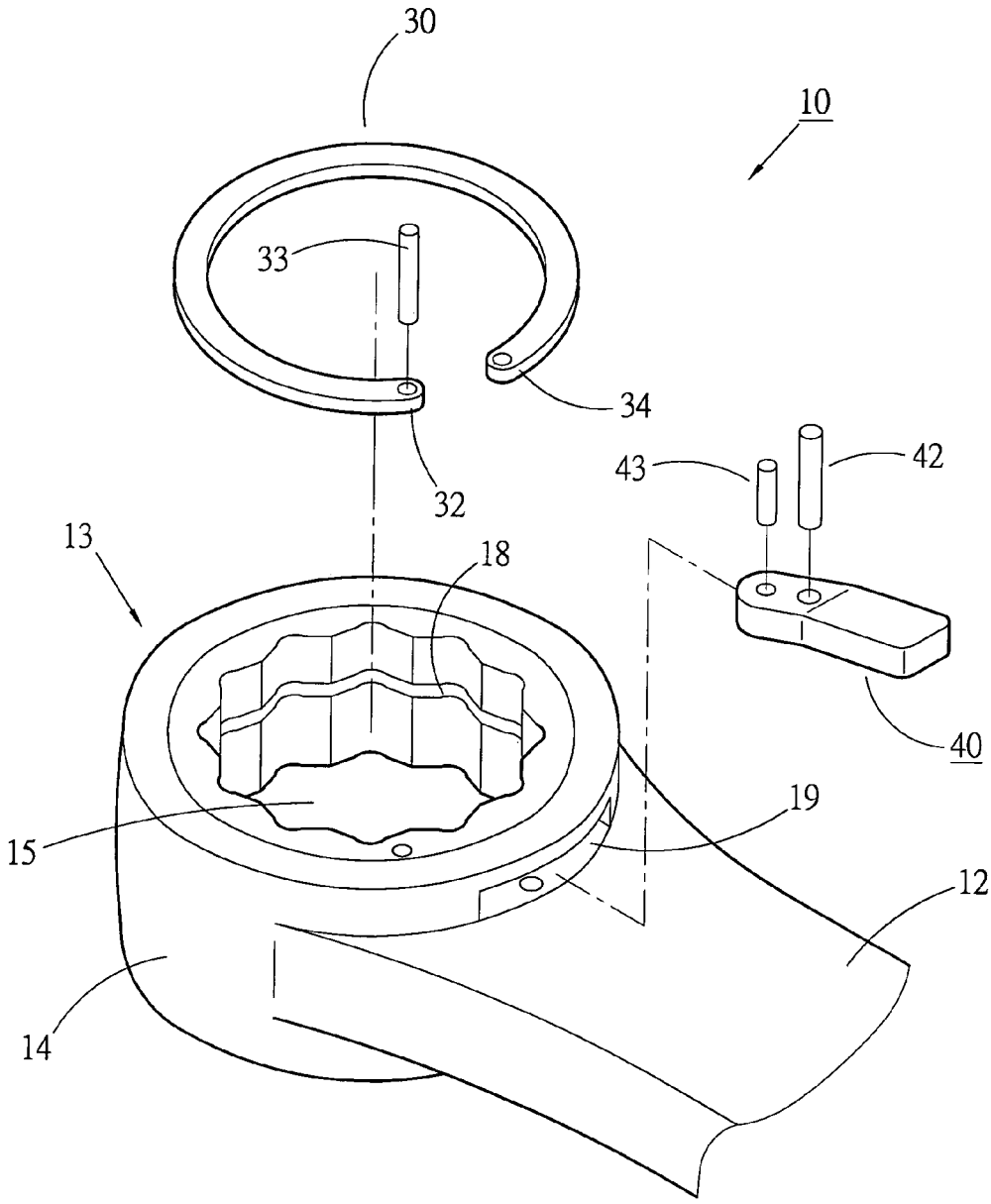
FIG. 2 is a perspective exploded view of the embodiment of FIG. 1.

Please refer to FIGS. 1 and 2. According to a first embodiment, the wrench of the present invention is a fixed wrench 10.

One end of the stem 12 of the wrench 10 is a box end 13 having a head section 14. The head section 14 is formed with a polygonal socket 15. The socket 15 can be hexagonal, quadrangular, octagonal or dodecagonal in accordance with the profile of the screwed member. The polygonal socket 15 has multiple inner angles 16 at equal intervals. This pertains to prior art and will not be further described hereinafter. An annular groove 18 is formed on the circumference of the socket 15 at one end thereof.

Figure 3:
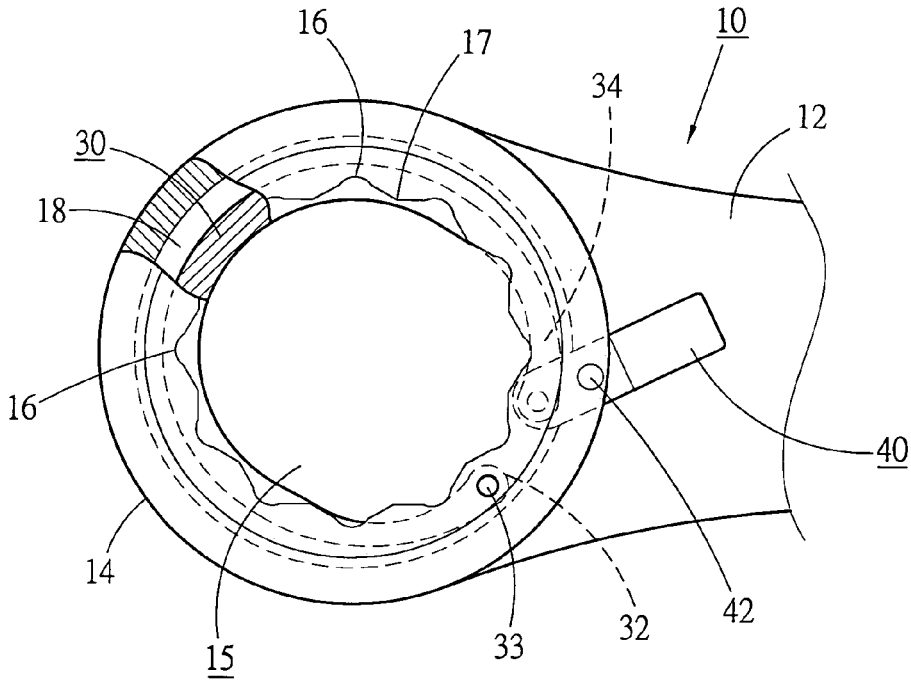
FIG. 3 is a top partially sectional view of the embodiment of FIG. 1, showing that the resilient ring is positioned in the closed position in normal state.

A substantially C-shaped resilient ring 30 is disposed in the annular groove 18. The resilient ring 30 can be resiliently opened and closed to change the inner diameter. One end of the resilient ring 30 is a fixed end 32 pivotally disposed in the head section 14 via a pin 33 as shown in FIG. 3. The other end of the resilient ring 30 is a movable end 34. The body of the resilient ring 30 overlaps the circumference of the socket.

A bar-like controlling switch 40 is pivotally disposed in the head section 14 via a pin 42. One end of the controlling switch 40 is pivotally connected with the movable end 34 of the resilient ring via a pin 43 as shown in FIGS. 1 and 3. In this embodiment, the outer circumference of the head section 14 is formed with a slot 19 passing through the head section 14 to the socket 15. An inner end of the controlling switch 40 extends through the slot 19 to pivotally connect with the movable end 34 of the resilient ring. An outer end of the controlling switch is positioned on outer side of the head section for an operator to shift.

Referring to FIGS. 1 and 3, in normal state, the resilient ring 30 is positioned in a closed position. Under such circumstance, the inner circumference of the resilient ring protrudes into the socket 15 to obstruct the inner teeth 16 thereof. The outer circumference of the resilient ring is spaced from the circumference of the annular groove 18 by a gap for providing a space for the resilient ring to expand. The controlling switch 40 is resiliently forced by the resilient ring to keep in a first position. It should be noted that the resilient ring only needs to obstruct more than one inner angle 16. It is unnecessary for the resilient ring to obstruct all the inner angles.

Figure 4:
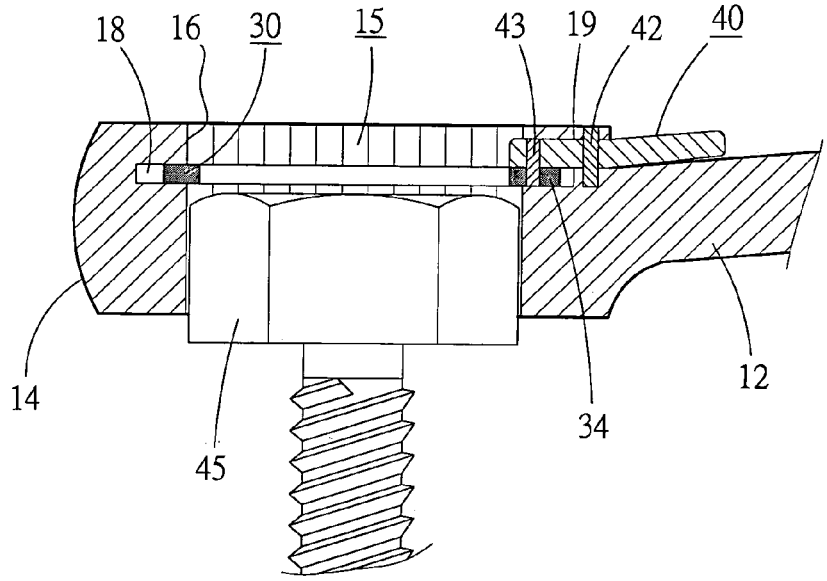
FIG. 4 is a longitudinal sectional view of the embodiment of FIG. 1, showing the use thereof.

FIG. 4 shows that the resilient ring is positioned in the closed position for use. Under such circumstance, the inner angle 16 of the socket 15 is obstructed by the resilient ring 30 so that when the socket 15 of the wrench 10 is fitted onto the screwed member 45, the screwed member is stopped by the resilient ring 30 from slipping out of the socket. Therefore, the wrenching operation is facilitated.

Figure 5:
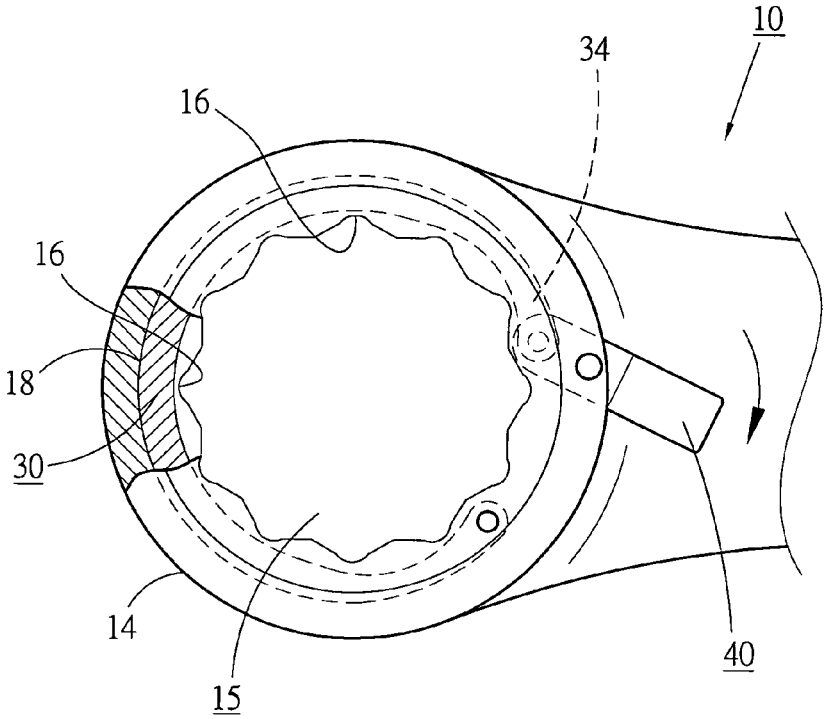
FIG. 5 is a view according to FIG. 3, showing that the resilient ring is positioned in the expanded position.
Figure 6:
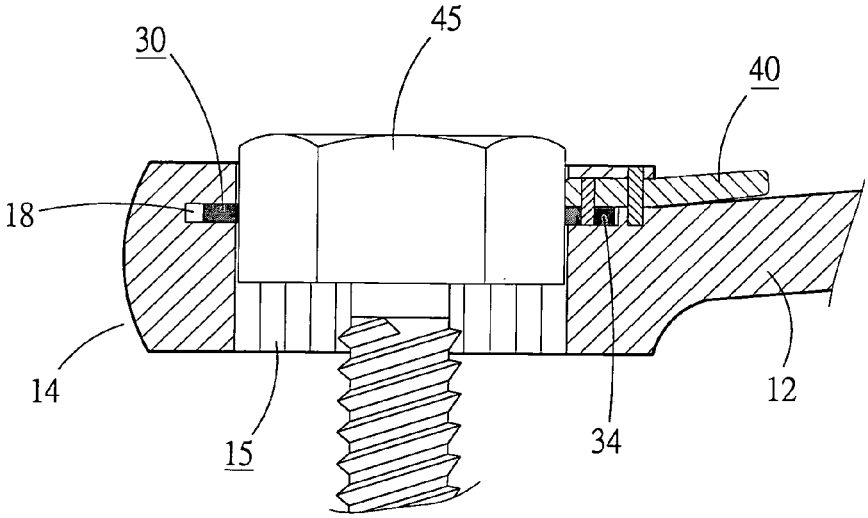
FIG. 6 shows that the wrench of the present invention clamps a screwed member in one state.
Figure 7:
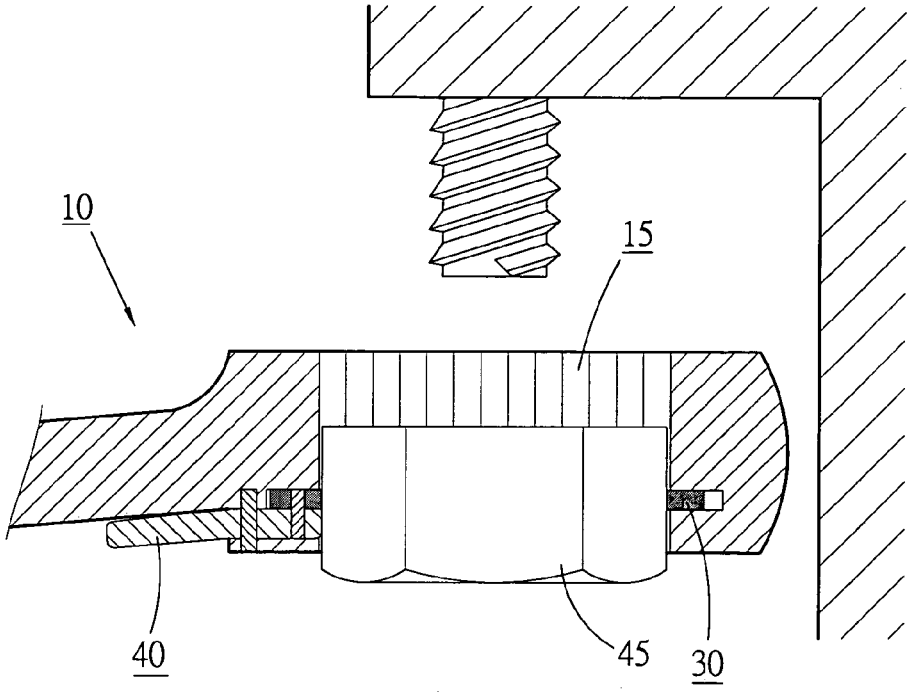
FIG. 7 shows that the wrench of the present invention clamps a screwed member in another state.

Referring to FIG. 5, when the controlling switch 40 is shifted to a second position, the movable end 34 of the resilient ring 30 is pushed by the controlling switch to expand the resilient ring into the annular groove 18 and free the inner angle 16. At this time, the inner angle is not obstructed. As shown in FIG. 6, when the socket is fitted onto the screwed member 45, the screwed member is moved to a position where the resilient ring is positioned. Then the controlling switch is released from the shifting force and the resilient ring 30 is resiliently restored and closed to clamp the outer circumference of the screwed member 45 and hold the screwed member 45 in the socket 15. A user can wrench the screwed member in a forward using state as shown in FIG. 6 or wrench the screwed member in a backward using state in a special environment as shown in FIG. 7.

In addition, in the state of FIG. 5., the resilient ring 30 is moved into the annular groove 18 without obstructing the inner angle. Therefore, the screwed member can freely pass through the socket 15. In the state of FIG. 6, when the resilient ring is expanded by means of shifting the controlling switch, the screwed member is released from the clamping force and can be easily detached from the socket.

Figure 8:
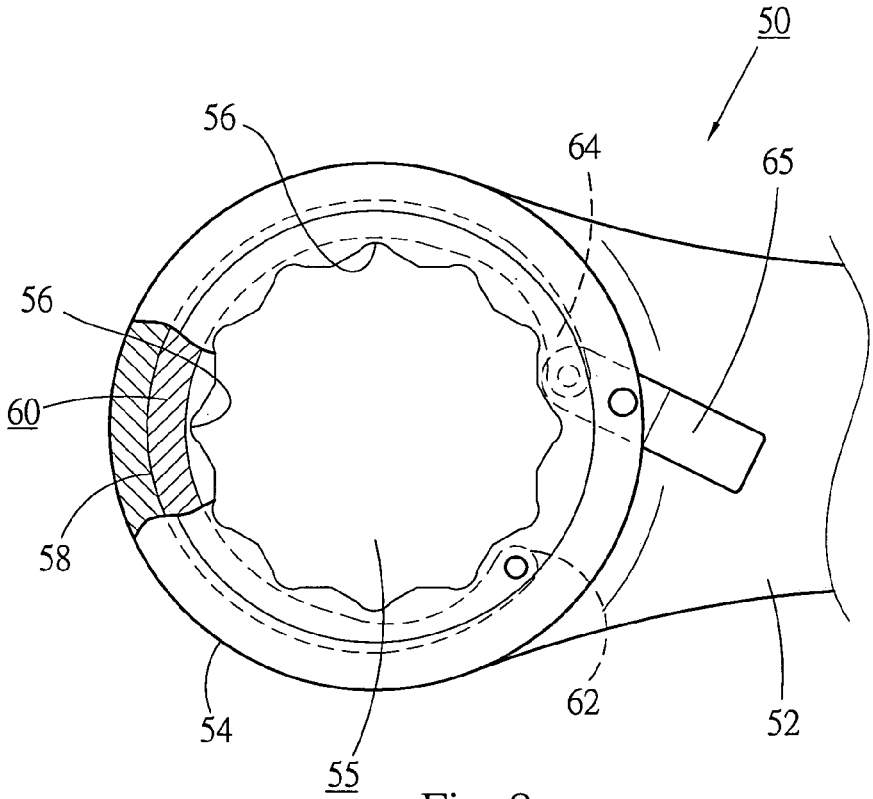
FIG. 8 is a top partially sectional view of another embodiment of the present invention.
Figure 9:
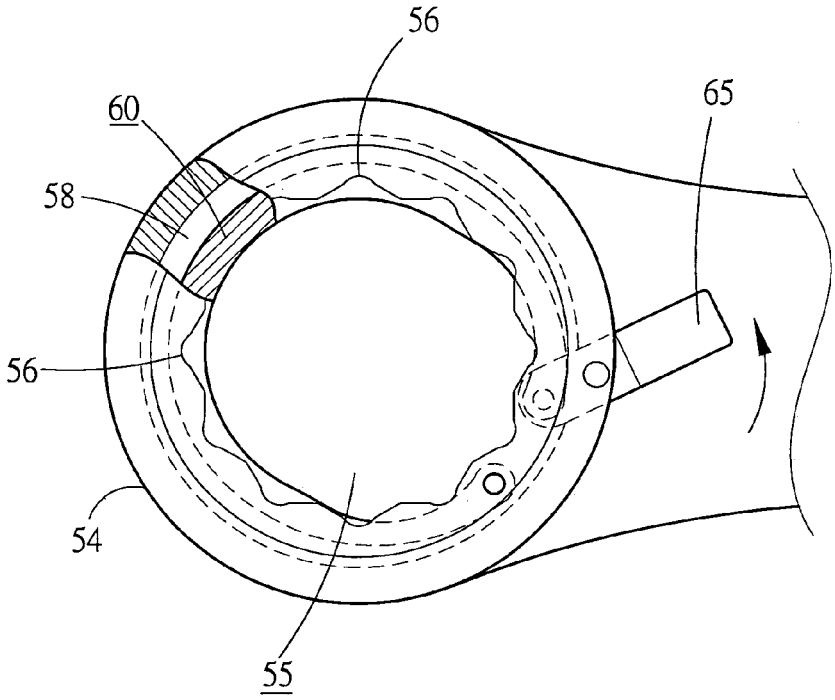
FIG. 9 shows that the resilient ring of FIG. 8 is positioned in another position.

FIGS. 8 and 9 show a second embodiment of the wrench 50 of the present invention, which has a structure identical to that of the first embodiment.

The head section 54 at one end of the stem 52 of the wrench 50 is formed with a polygonal socket 55 and an annular groove 58 along the circumference of the socket.

A resilient ring 60 is disposed in the annular groove 58. The fixed end 62 of the resilient ring 60 is pivotally disposed in the head section 54. The movable end 64 is connected with a controlling switch 65 pivotally disposed on the head section and driven by the controlling switch.

In normal state, the resilient ring 60 keeps in an expanded state. The inner circumference of the resilient ring 60 is spaced from the inner angle 56 of the socket 55 without obstructing the inner angle. Accordingly, the screwed member can freely pass through the socket. In normal state, the controlling switch 65 is resiliently forced by the resilient ring 60 to keep in a first position.

As shown in FIG. 9, when the user shifts the controlling switch 65 to a second position, the movable end 64 of the resilient ring 60 is moved to reduce the diameter of the resilient ring. At this time, the inner circumference of the resilient ring protrudes into the socket 55 to obstruct the inner angle 56. Under such circumstance, when the socket 55 is fitted onto the screwed member, the screwed member is stopped by the resilient ring 60 from detaching out of the socket. The user can also use the resilient ring to clamp the screwed member. The operator can hold the stem 52 with one hand and shift the controlling switch 65 with the thumb.

Figure 10:
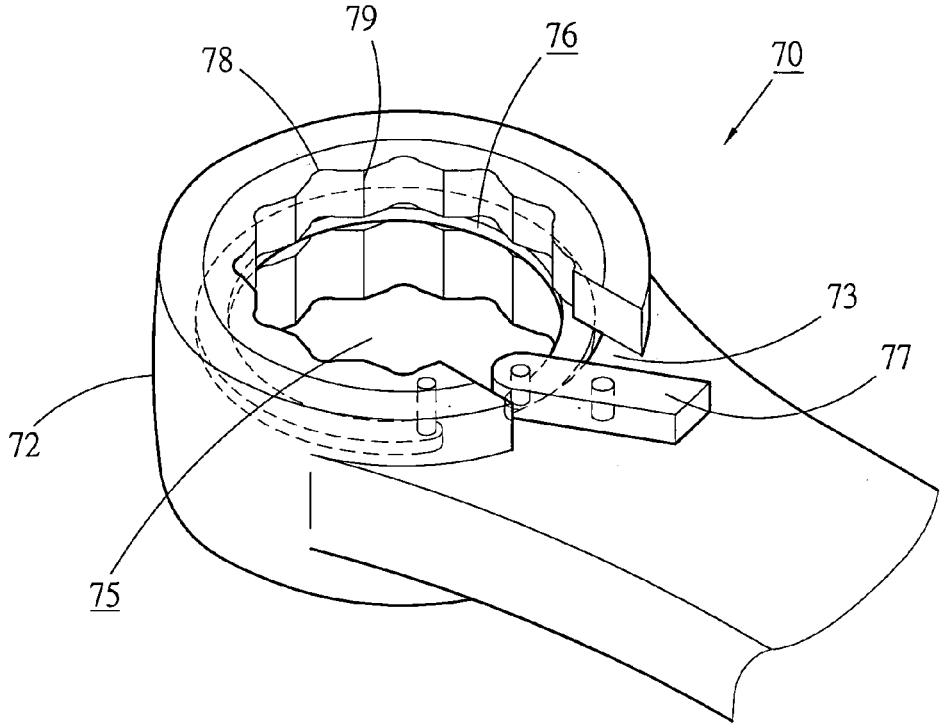
FIG. 10 is a perspective view of still another embodiment of the present invention.

FIG. 10 shows a third embodiment of the wrench 70 of the present invention, in which the resilient ring 76 mounted in the socket 75 can be closed or expanded in normal state. This embodiment is mainly different from the above embodiments in that the top end of the head section 72 is formed with a recess 73 communicating with the socket 75 and outer circumference of the head section. The controlling switch 77 is pivotally disposed in the recess 73. The inner end of the controlling switch is pivotally connected with the movable end of the resilient ring, while the outer end is positioned on outer side of the head section for a user to shift.

The use of the third embodiment is identical to the first and second embodiments.

In normal state, when the resilient ring is positioned in the closed position, the inner circumference of the resilient ring can only obstruct the inner angle 78 without obstructing the teeth 79 as shown in FIG. 10. Alternatively, as shown in FIG. 3, the inner circumference of the resilient ring can obstruct both the inner angle 16 and the teeth 17.

Figure 11:
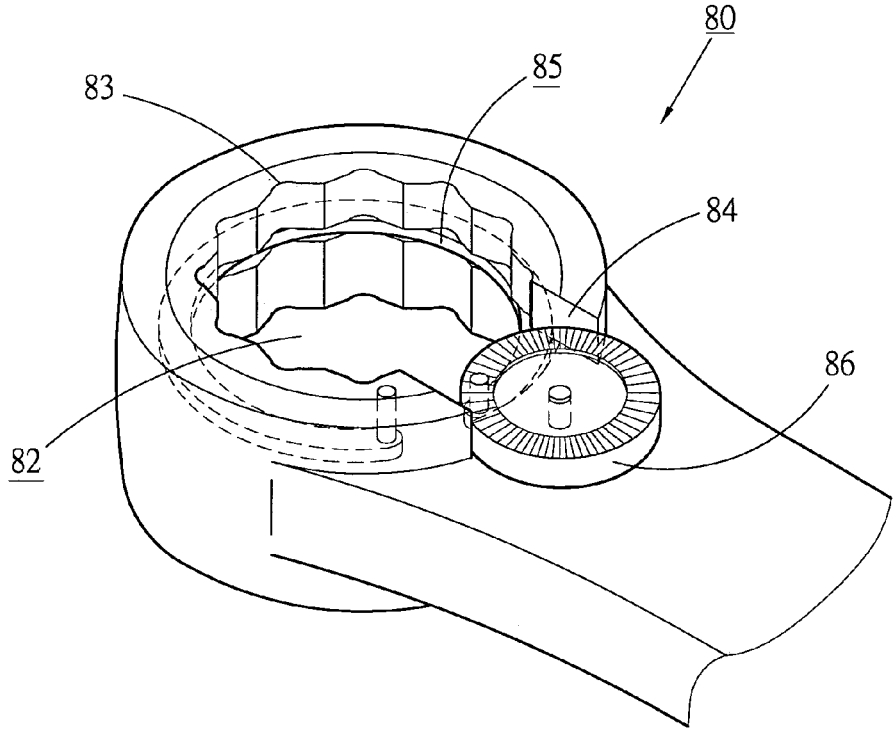
FIG. 11 is a perspective view of still another embodiment of the present invention.

FIG. 11 shows a fourth embodiment of the wrench 80 of the present invention, the structure of which is substantially identical to any of the above embodiments. The fourth embodiment is different from the above embodiments in that the controlling switch 86 is a rotary switch pivotally disposed in the recess 84 (or slot) of the head section 81 of the wrench for a user to manually rotate. The inner circumference of the controlling switch 86 is pivotally connected with the movable end of the resilient ring 85. When the controlling switch is turned, the resilient ring is driven from a normal position to a forced position to obstruct the inner angle 83 of the socket 82 or free the inner angle 83.

The above embodiments are all fixed wrenches. However, the present invention is also applicable to ratchet wrench.

Figure 12:
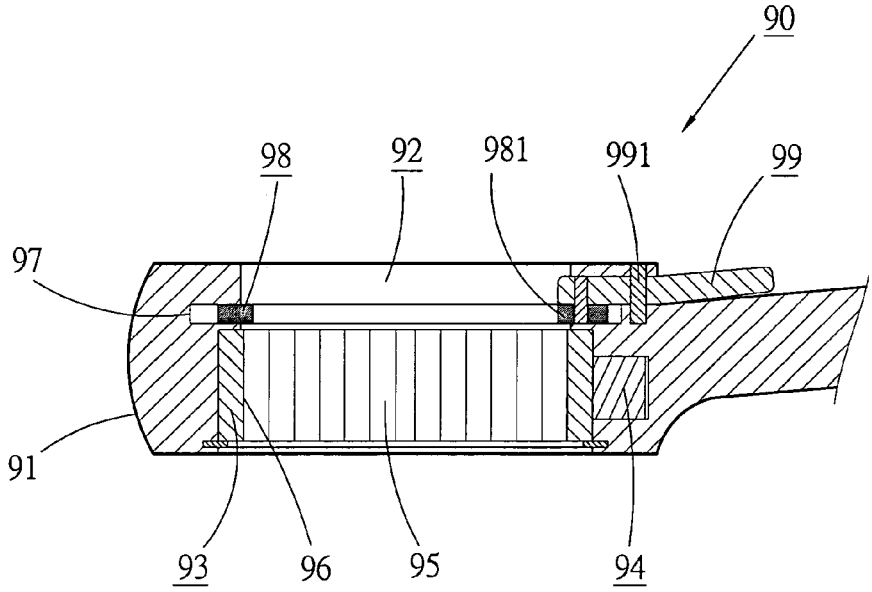
FIG. 12 is a longitudinal sectional view of still another embodiment of the present invention.

FIG. 12 shows a fifth embodiment of the wrench 90 of the present invention, which is a ratchet wrench. The head section 91 of the wrench is formed with a through hole 92 in which a ratchet wheel 93 is pivotally disposed. A detent 94 is disposed in the head section 91 for engaging with the ratchet wheel for one-way driving the screwed member. A polygonal socket 95 is formed in the ratchet wheel. The ratchet structure pertains to prior art and will not be further described hereinafter. An annular groove 97 is formed on the inner circumference of the through hole 92 above the ratchet wheel 93. A resilient ring 98 is disposed in the annular groove. The fixed end of the resilient ring is pivotally disposed in the annular groove. A controlling switch 99 is pivotally disposed on the head section via a pin 991 for a user to shift. The controlling switch can be a bar member or a rotary switch. The inner end (or circumference) of the controlling switch is pivotally connected with the movable end 981 of the resilient ring 98.

In normal state, the resilient ring 98 can be closed or expanded. In the closed position, the resilient ring obstructs the inner angle 96 to prevent the screwed member from detaching out of the socket 95 or resiliently clamp and hold the screwed member in the socket. In the expanded position, the screwed member can pass through the socket.

The controlling switches 78, 86 of the third and fourth embodiments are applicable to this embodiment.

Figure 13:
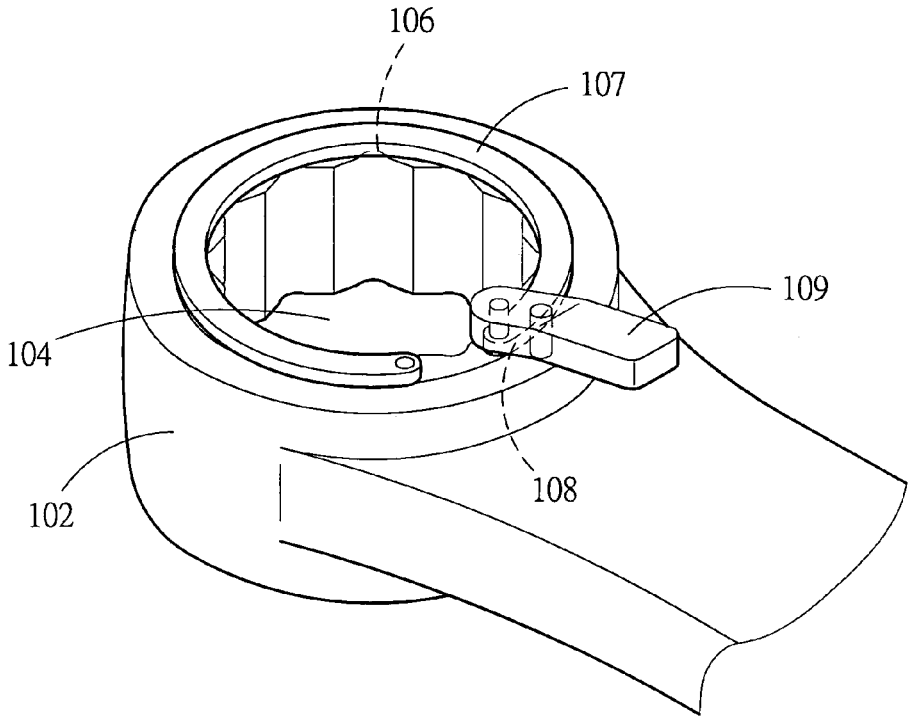
FIG. 13 is a perspective view of still another embodiment of the present invention.
Figure 14:
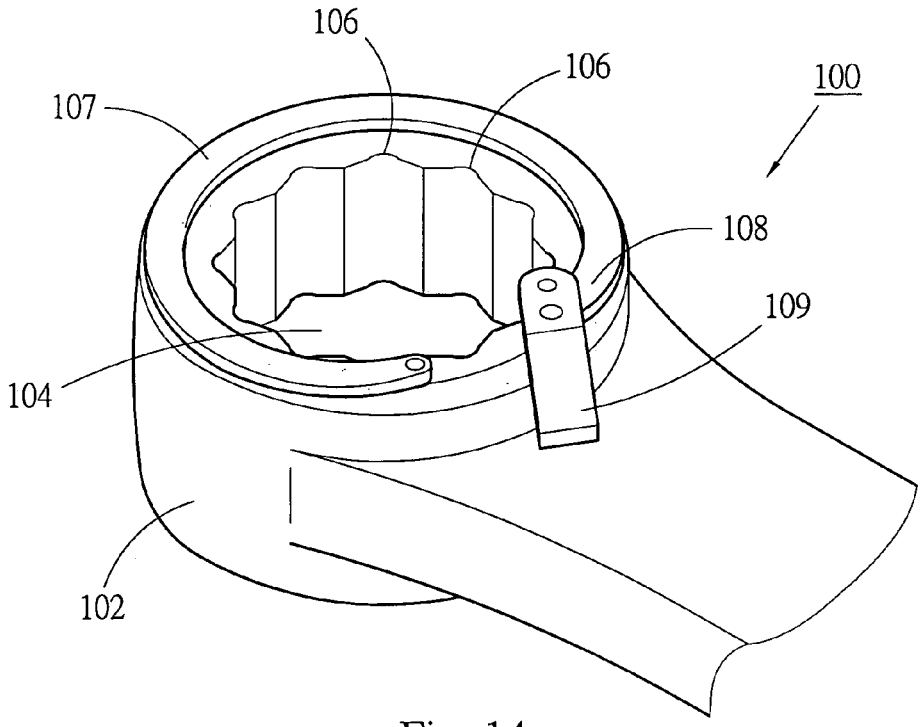
FIG. 14 shows that the resilient ring of FIG. 13 is positioned in another position.

FIG. 13 shows a sixth embodiment of the wrench 100 of the present invention, which is different from the above embodiment in that the resilient ring 107 is not disposed in the head section 102. Instead, the resilient ring 107 is directly disposed at one end (top end or bottom end) of the head section 102. In normal state, the inner circumference of the resilient ring obstructs the inner angle 106 of the socket 104. When the controlling switch 109 is shifted to drive the movable end 108 of the resilient ring as shown in FIG. 14, the resilient ring 107 is expanded without obstructing the inner angle 106.

Similarly, the structure of this embodiment is applicable to the ratchet wrench of the fifth embodiment.

According to the above arrangement, the wrench of the present invention is able to prevent the screwed member from slipping out and clamp the screwed member. Also, the wrench of the present invention permits the screwed member to pass through the socket.

The above embodiments are only used to illustrate the present invention, not intended to limit the scope thereof. Many modifications of the above embodiments can be made without departing from the spirit of the present invention.

What is claimed is:

1. A wrench capable of claiming a screwed member and preventing the screwed member from slipping out of a socket of the wrench and permitting the screwed member to pass through the socket, said wrench comprising:

a stem having a head section at one end of the stem;

a polygonal socket formed in the head section, the socket having multiple inner angles for fitting onto the screwed member;

a substantially C-shaped resilient ring having two ends, the resilient ring being resiliently closable and openable between a closed state and an expanded state to change the diameter of the resilient ring, the resilient ring being disposed at the head section to overlap the circumference of the socket, one end of the resilient ring being fixed end pivotally disposed at the head section, while the other end of the resilient ring being a movable end; and a controlling switch pivotally disposed at the head section and movable between a first position and a second position, the controlling switch being pivotally connected with the movable end of the resilient ring, whereby when operating the controlling switch, the resilient ring is driven to expand or close, in the closed position, the resilient ring obstructing at least one inner angle of the socket, in the expanded position, the resilient ring freeing the inner angle without obstructing the same, and wherein an annular groove is formed on an inner circumference of the socket and the resilient ring is disposed in the inner annular groove.

2. The wrench as claimed in claim 1, wherein in normal state, the resilient ring keeps in the closed position.

3. The wrench as claimed in claim 1, wherein in normal state, the resilient ring keeps in the expanded position.

4. The wrench as claimed in claim 1, wherein in normal state, the resilient ring keeps in the closed position and a gap is defined between the outer circumference of the resilient ring and the circumference of the annular groove.

5. The wrench as claimed in claim 1, wherein in normal state, the resilient ring keeps in the expanded position.

6. The wrench as claimed in claim 1, wherein the head section is formed with a slot passing through the circumference of the head section to the socket, the controlling switch being pivotally disposed in the slot.

7. The wrench as claimed in claim 1, wherein the resilient ring is adjacent to one end of the head section, an end face of the end of the head section being formed with a recess in which the controlling switch is disposed.

8. The wrench as claimed in claim 1, wherein the controlling switch is a bar member, an inner end of the controlling switch being pivotally connected with the movable end of the resilient ring, an outer end of the controlling switch being exposed to outer side of the head section.

9. The wrench as claimed in claim 1, wherein the controlling switch is a rotary switch, an inner circumference of the controlling switch being pivotally connected with the movable end of the resilient ring.

10. The wrench as claimed in claim 1, wherein the resilient ring and the controlling switch are pivotally disposed at one end of the head section.

11. The wrench as claimed in claim 1, wherein the head section is formed with a through hole in which a ratchet wheel is pivotally disposed, the socket being formed in the ratchet wheel, a detent being disposed in the head section for engaging with the ratchet wheel for one-way driving the screwed member.

12. The wrench as claimed in claim 11, wherein the resilient ring and the controlling switch are pivotally disposed at one end of the head section.

* * * * *